US007484275B2

(12) United States Patent
Carroll et al.

(10) Patent No.: US 7,484,275 B2
(45) Date of Patent: Feb. 3, 2009

(54) TRANSPORTABLE CONTAMINATED REMAINS POUCH

(75) Inventors: Todd R. Carroll, Guntersville, AL (US); Charles T. Vencill, Grant, AL (US)

(73) Assignee: Kappler, Inc., Guntersville, AL (US)

( * ) Notice: Subject to any disclaimer, the term of this patent is extended or adjusted under 35 U.S.C. 154(b) by 0 days.

(21) Appl. No.: 10/722,244

(22) Filed: Nov. 25, 2003

(65) Prior Publication Data

US 2009/0007402 A1 Jan. 8, 2009

Related U.S. Application Data

(60) Provisional application No. 60/429,850, filed on Nov. 27, 2002.

(51) Int. Cl.
*A61G 1/00* (2006.01)

(52) U.S. Cl. ..... 27/28; 383/103

(58) Field of Classification Search ..... 27/28, 27/7, 11; 383/66, 67, 109, 100, 103; 493/186, 493/189, 212–214; 220/89.1; 206/524.8
See application file for complete search history.

(56) References Cited

U.S. PATENT DOCUMENTS

| | | | |
|---|---|---|---|
| 39,291 | A | 7/1863 | Holmes |
| 924,029 | A | 6/1909 | Barnes |
| 4,301,791 | A | 11/1981 | Franco, III |
| 4,485,490 | A | 12/1984 | Akers et al. |
| 4,790,051 | A | 12/1988 | Knight |
| 4,833,010 | A | 5/1989 | Langley |
| 4,855,178 | A | 8/1989 | Langley |
| 4,920,575 | A | 5/1990 | Bartasis et al. |
| 5,169,697 | A | 12/1992 | Langley et al. |
| 5,341,548 | A | 8/1994 | Zerick |
| 5,342,121 | A | 8/1994 | Koria |
| D356,420 | S | 3/1995 | Etzel et al. |
| 5,620,407 | A | 4/1997 | Chang |
| 5,659,933 | A | 8/1997 | McWilliams |
| D409,817 | S | 5/1999 | Engerfalk |
| 5,975,081 | A | 11/1999 | Hood et al. |
| 6,004,034 | A | 12/1999 | Salam |
| 6,052,877 | A | 4/2000 | Richard |
| 6,128,796 | A | 10/2000 | McCormick et al. |
| 6,195,822 | B1 | 3/2001 | Sorensen et al. |
| 6,321,764 | B1 | 11/2001 | Gauger et al. |
| 6,418,932 | B2 | 7/2002 | Paschal, Jr. et al. |
| 6,461,290 | B1 | 10/2002 | Reichman et al. |
| 2001/0029955 | A1 | 10/2001 | Paschal, Jr. et al. |
| 2001/0051481 | A1 | 12/2001 | Carroll |
| 2003/0145443 | A1 * | 8/2003 | Lee ..... 27/28 |

FOREIGN PATENT DOCUMENTS

| | | | |
|---|---|---|---|
| WO | WO 99/15128 | * | 4/1999 |
| WO | WO 02/074217 | * | 9/2002 |

* cited by examiner

*Primary Examiner*—William L. Miller
(74) *Attorney, Agent, or Firm*—Stites & Harbison PLLC; Richard S. Myers, Jr.

(57) ABSTRACT

A gas-tight, liquid-impervious, transportable contaminated remains pouch designed and configured for storage and/or movement of remains or other items such as evidence in forensic applications that have been or are suspected to have been contaminated.

23 Claims, 5 Drawing Sheets

TRANSPORTABLE CONTAMINATED REMAINS POUCH

This application claims priority to U.S. Patent Application No. 60/429,850, filed on Nov. 27, 2002, the contents of which are incorporated herein by reference in their entirety.

FIELD OF INVENTION

This invention relates generally to the field of casualty care and more specifically to the area of body bags and other receptacles designed for the safe storage and transport of contaminated bodies, remains, and/or forensic samples.

BACKGROUND OF THE INVENTION

The present invention relates to the art of body bags or pouches and more specifically to the safe storage and transportation of bodies and remains, or forensic samples that have been or are suspected to have been contaminated with military chemical and biological warfare agents, radiological hazards, and/or toxic industrial chemicals (TICS) and materials (TIMS). Of particular novelty, the present invention addresses the unique need for military and disaster relief personnel to safely handle and transport such contaminated remains for extended periods of time and/or under hypobaric conditions as occur during transport from the battlefield.

The present invention also may be used to transport equipment and other related items that are suspected as being contaminated.

The expanding threat of world terrorism and chemical/biological weaponization by third world and developing nations has heightened international awareness for the need for highly specialized protective devices and equipment. While significant effort has been placed on developing chemically resistant clothing, protective covers and shelters, air monitoring devices, and release plume modeling simulation, little effort has been placed on casualty care, and more specifically the management of contaminated bodies, remains, equipment, and the like, especially those casualties resulting on the battlefield.

While an array of traditional body bags exist, these devices have remained essentially unchanged and theoretically are designed to contain normal bodily fluids and gases resulting from natural decay and decomposition. Even with the onslaught of communicable diseases such as HIV and Ebola, the state-of-the-art body bag has remained essentially unchanged since its first use.

The unique hazards involved with battle ground casualties and more recently those resulting during terrorist activities, is the potential inclusion of chemical, radiological, and biological contamination along with the ever present pathogenic hazards and traditional by products of human decay and decomposition. While traditional body bags can be designed to offer varying degrees of "liquid-proofness", traditional fabrics and closures (i.e., zipper and two track or press-to-close Zip-Lock™-type closures) fail to offer the necessary chemical resistance for the new level of challenges. Furthermore, complications exist in bags that claim to be gas-tight since dangerous over-pressurization can occur during decomposition and in hypobaric conditions occurring during transportation (a common practice, especially in military situations). Typical military practice in transporting remains of fallen soldiers is to transport such remains in the non-pressurized cargo areas of aircraft. It should be obvious that a truly gas-tight body bag that has been filled and closed while on the ground at essentially atmospheric pressure, will experience sever over-pressurization when transported at hypobaric conditions as will occur during flight (i.e., high altitude). Severe over-pressurization can lead to leakage and under the most severe conditions, full catastrophic failure. Failure or leakage of a bag holding contaminated remains could obviously result in contamination of the cargo vessel, other equipment, etc. and presents a risk to others onboard as well as individuals involved with off-loading after landing.

Conventional body bags used by civilian and military medical, mortuary, and investigative personnel are similar in materials of construction, design, seaming, and closures. These items offer satisfactory performance under only a limited number of scenarios. The added chemical and physical threats involved with battle ground and terrorist disaster response severely challenge the performance limitations of modern body bags. Some of the early work in the subject area was conducted by Dr. Thomas Holmes in 1863. Holmes patented an improved receptacle for dead bodies (U.S. Pat. No. 39,291, the contents of which are incorporated herein by reference) wherein he configured an oval-shaped elastic receptacle having a funnel-shaped top into which is placed a badly wounded body. The receptacle is tied around the top and a cork is inserted in the opening to create an "air-tight" closure. Holmes specifies the use of an Indian-rubber or similar air-tight elastic cloth. While rudimentary in design and materials, Holmes does begin to identify the critical attributes of a readily field deployable, gas-tight, chemically-resistant remains pouch. Carl Barnes discloses a transportation-receptacle for dead human bodies in his patent of 1909 (U.S. Pat. No. 924,029, the contents of which are incorporated herein by reference). Barnes describes a coffin-like device for transporting remains that comprises a receptacle fabricated from rubber or other similar "imperforate" material including a multi-layer overlapping closure secured with buttons. While addressing the hazards of the day (i.e., blood and other bodily fluids) these approaches are obviously insufficient for the present day need for a hypobaric transportable highly chemically resistance remains pouch.

Modern body bags as available through Burney Products, Knight Systems Inc., Mopec, Lightning Powder Company, Inc., Chief Supply, ADI Medical, and others, are commonly categorized as either lightweight/standard duty or heavy duty. Typical materials of construction include polyethylene sheeting, polyethylene laminates to woven or nonwoven support fabrics, or varying weights of supported and unsupported polyvinyl chloride (PVC) and/or polyurethane. Predominately rectangular in shape, seaming is accomplished via traditional needle and thread sewing, impulse welding, radio frequency welding, or other similar thermal seaming techniques. These body bags are also typically fitted with curved zipper or zip-lock™-type closures located on either the side or top of the bag. Even the common DOD human remains pouch, as described under National Stocking Number NSN: 9930-01-331-6244 is constructed of vinyl and includes a standard cloth zipper, which has little utility when handling contaminated remains.

Salam (U.S. Pat. No. 6,004,034) and Engerfalk (U.S. Pat. No. Des. 409,817) the contents of which are incorporated herein by reference, have attempted to simplify the design and construction of a standard body bag to reduce cost. While functional for traditional use, the products described above have proved impractical for use under the high hazard scenarios described by the subject patent.

Others have attempted to address the need for a chemically resistant, odor-proof remains bag for use during military and disaster events. Knight (U.S. Pat. No. 4,790,051, the contents of which are incorporated herein by reference), discloses an odor-proof disaster pouch constructed of a strong, flexible, waterproof material for transporting dead human bodies. Knight describes a multi-walled bag comprising an inner liner and an outer liner which are constructed of vinyl. Closure of the devices is accomplished using both traditional zippers and rib-in-groove (i.e., Zip-lock type) devices. Knight also describes a standard reinforcing/weight supporting system of interconnected straps secured to the under side of the bag to facilitate handling the bag. Knights use of a vinyl base material and traditional zipper and zip-lock type closures results in nothing more than a bag in a bag approach. While this body bag could be considered "liquid-proof", the vinyl-based primary material offers limited chemical resistance, and the closure system could not prevent the leakage of potentially dangerous contaminates and byproducts of decay and decomposition during long-term storage or hypobaric transport. Long-term storage of the Knight bag is also of concern as those skilled in the art know that rib-in-grove closures are best suited for flat installation, and often fail when folded for extended periods of time due to the "set" induced in the groove. Furthermore, neither traditional zipper nor zip-lock type closures are designed for hypobaric conditions and would surely fail while at altitude.

McWilliams (U.S. Pat. No. 5,659,933, the contents of which are incorporated herein by reference) better addresses the chemical resistant needs of a contaminated remains pouch than does Knight or others in his description of an odor-proof sealable container for bodily remains. McWilliams describes a tubular shaped device open on both ends, and constructed of a flexible multi-layered laminate including at least two polymeric sheets sandwiched around a metal foil-layer. Human remains are inserted into one end of the bag, and the ends are sealed using common heat sealing techniques or through the use of adhesives. The bag does not contain any openable closures, but does include a self-sealing valve to allow the extraction of decomposition gases and/or the insertion of inert gases that can extend non-refrigerated storage of the remains.

While McWilliams begins to address the chemically resistive needs of a contaminated remains bag, his approach is impractical for battlefield or disaster use for several reasons. Insertion of complete bodies and remains into the tubular device is not only difficult but can easily and most likely contaminate the seam interface on one or both ends. Since McWilliams relies on either a hermetic or adhesive seal being created on each end of his bag, the presence of blood, bodily fluids, or other debris in the seal area after insertion of the remains will drastically impact the likelihood of achieving a good seal, thus leading to leakage and failure of the bag. The present invention overcomes this limitation by offering an openable remains pouch that includes a valving system that controls the release of any toxic gases from the bag, but also functions as an in-process control and is used during production to quality check the integrity of all seams in the remains pouch. McWilliams' use of a self-sealing valve may have application at atmospheric conditions, but will be easily overcome when placed under the high internal pressure that occurs during hypobaric flight. One final significant shortcoming of the McWilliams approach is its lack of field deployability. In this regard, McWilliams fails to disclose or suggest a mechanism whereby the remains bag can be easily and safely drug as in typical military or disaster-type situations or carried as in more common medical/mortuary settings.

Other work either has been conducted or is still in process that addresses a related but different need when catering the specialized conditions of caring for chemically contaminated patients. Sustaining the life of a contaminated patient is quite different and requires a much different philosophy than does containing contaminates present on deceased victims. Pashal, Jr. et. al (U.S. Pat. No. 6,418,932 B2), Koria (U.S. Pat. No. 5,342,121), Hood et. al, (U.S. Pat. No. 5,975,081), Reichman et. al., (U.S. Pat. No. 6,461,290 B1), Gauger et. al., (U.S. Pat. No. 6,321,764 B1), Chang (U.S. Pat. No. 5,620,407), Akers et. al, (U.S. Pat. No. 4,485,490), all of which are incorporated herein by reference, as well as others have addressed controlling hazardous exposure of care takers to contaminated patients. These approaches vary in their complexity and level of sophistication, but none are economical enough or easily deployable for use when handling contaminated remains and the like.

It should be obvious from the discussion above that an immediate needs exists for a field deployable contaminated remains pouch that offers high chemical resistance, good physical durability, allows for ready insertion of and access to remains, can be manipulated by one or more handlers, is so designed to prevent the undesirable build-up of toxic vapors and gases under both atmospheric and hypobaric conditions, and is constructed in such a way so as to allow in-production quality assurance testing to ensure the gas-tight integrity of the complete final unit.

SUMMARY OF THE INVENTION

The present invention provides for a novel transportable contaminated remains or forensic samples pouch that is designed for the storage and transportation of remains that have been or are suspected to have been contaminated with military chemical and biological warfare agents, radiological hazards, and/or toxic industrial chemicals (TICS) and materials (TIMS).

The pouch is comprised primarily of a multi-layered chemically resistant material. Examples of this material include the material described by Langley (U.S. Pat. Nos. 4,833,010 and 4,855,178), Carroll (U.S. application Ser. No. 09/128,721), Bartasis (U.S. Pat. No. 4,920,575) the contents of all of which are incorporated herein. Further examples include other commercially available high chemical barrier composites.

The remains bag of the present invention may be configured with a closure system such as a top or side closure system that incorporates a single or multiple gas-tight zippers such as are commercially available from YKK, RIRI, and Dynat.

In other embodiments, to ensure high strength and chemical resistance of the seams, the seams in the remains pouch may be sewn and then hermetically heat-sealed using one or more layers of a high chemical barrier heat seal tape such as that described by Langley (U.S. Pat. No. 5,169,697).

In one embodiment, this gas-tight pouch can be fitted with an air management system to prevent over-pressurization resulting from decay and decomposition as can occur during hypobaric transport. The air management system can be comprised of one of several uni-directional filtered valving systems designed to vent contaminated air from the pouch but prevent the influx of water and detoxification agents into the bag during decontamination processing. In other embodiments, the venting system can also be used as part of a production quality assurance program to ensure the gas-tight integrity of the finished item.

The pouch of the present invention can include an abrasion resistant layer either affixed to the bottom of the bag or incorporated into the multi-layered chemical barrier materials. Additionally, the pouch of the present invention can be fitted with a carrying/support structure fabricated from high strength webbing to facility handling a "full" pouch. The pouch of the present invention can also optionally be further fitted with a fluid collection reservoir designed to isolate and control blood, body fluids, and/other liquids coming from the remains or forensic samples. The collection reservoir if this embodiment may be based on super adsorbent polymer (SAPs) technology as is common in the art of fluid adsorption.

In an embodiment of the present invention, the present invention is directed to a container for storing or transporting at least one contaminated item that comprises a plurality of polymeric, multi-layered chemical composite flexible walls that are impervious to gases and liquid and define an enclosure that define an interior chamber that has sufficient dimensions to accommodate said contaminated item; a gas-tight closable and openable opening for placing and removing said contaminated item in the interior chamber; and an air management system that filters and releases air pressure from the inside of said enclosure.

In another embodiment, the present invention is directed to a gas-tight pouch for transporting contaminated items that comprises a polymeric multi-layered chemical composite barrier fabric stitched to form seams which define an enclosed pouch; an opening and closing device to allow access to the pouch for inserting and removing contaminated items; and an air release valve to filter and release pressurized air from within the pouch.

In both the above embodiments the chemical composite barrier fabric may comprise polyvinyl chloride, chlorinated polyethylene, chlorinated butyl, polyethylene, high density polyethylene, low density polyethylene, linear low density polyethylene, polypropylene, polyurethane, PTFE, combinations thereof, or multiple-layered coextruded films which include one or more layers of ethylene-vinyl acetate, ethylene vinyl alcohol, polyvinyl alcohol, nylon, Surlyn, polyester.

BRIEF DESCRIPTION OF THE DRAWINGS

The following drawings depict preferred examples of the present invention. These drawings/examples are given for illustration of embodiments of the present invention, and are not intended to be limiting thereof.

DESCRIPTION OF THE PREFERRED EMBODIMENTS

Numerous embodiments of the disclosed invention have been conceived to demonstrate the potential breadth and significance of the claimed art. Inclusion of these embodiments in no way serves to limit the potential breath and applicability of the disclosed art to other configurations and or uses.

Chemical Barrier Fabric

The present invention can accommodate a variety of barrier fabrics, as well as a variety of air exchange mechanisms. The preferred embodiment as shown in FIGS. 1-6 is a contaminated remains pouch fabricated from a high chemical barrier fabric 1, Zytron CSM® (Kappler, Inc., Guntersville, Ala.). This multi-layered, high chemical fabric has a weight of approximately 8.4 oz/yd$^2$. This fabric is disclosed in U.S. Pat. Nos. 4,855,178 and 4,833,010, the contents of which are incorporated herein. The chemical barrier fabric of the present invention may be a fabric of 4,833,010. Examples of this fabric are effective when tested against more than 300 toxic industrial chemicals and have a mullen burst strength of about 174 psi, a grab tensile strength of about 92 lb (warp)/about 93 lbs (fill), and a trapezoidal tear strength of about 19 lb (warp)/about 19 lbs (fill).

Chemical testing for the fabric of this embodiment has includes Mustard (HD), Lewiste (L), Tabun (GA), Sarin (GD), and Nerve (VX) all of which show breakthrough times greater than about 480 minutes when tested in accordance with MIL-STD-282 methods 208 and 209.

Thus, a fabric used in connection with the present invention may be a multilayer chemical barrier fabric that is made up of a base sheet of nonwoven polypropylene laminated to a multilayer film sheet having a film of ethylene vinyl alcohol sandwiched between films of nylon with a surface film of linear low-density polyethylene. Fabrics of this embodiment show resistance to breakthrough within about 8 hours for 13 of 15 chemicals listed on the ASTM F1001 chemical test battery and shorter breakthrough times for the other two.

Figure 7:
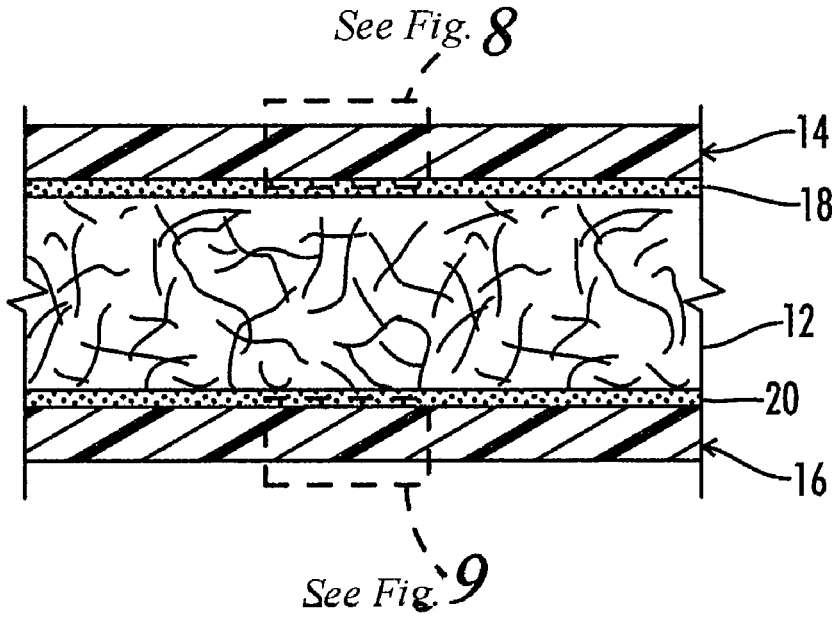
FIG. 7 shows a cross section of an example of the multi-layered chemically resistant material that can be used for the pouch of the present invention.

FIG. 7 shows an example of a fabric of this embodiment. In FIG. 7, a composite fabric material 1 is shown. The composite of this embodiment includes a base or middle sheet 12 of nonwoven polypropylene fabric having a first multilayer sheet 14 laminated to one face and a second multilayer sheet 16 laminated to its opposite face with layers 18, of adhesive disposed between faces of the base sheet and the sheets laminated thereto.

Nonwoven polypropylene available from Phillips Fibers Corporation under the trademark "Duon" may be used for the base fabric 12. A 2.3-ounce fabric designated as L17307 is preferred. Other fabrics which are bondable to the film sheets of the composite and which provide voids between the film sheets may be used, for example, fabrics of other polymeric materials such as polyesters.

Figure 8:
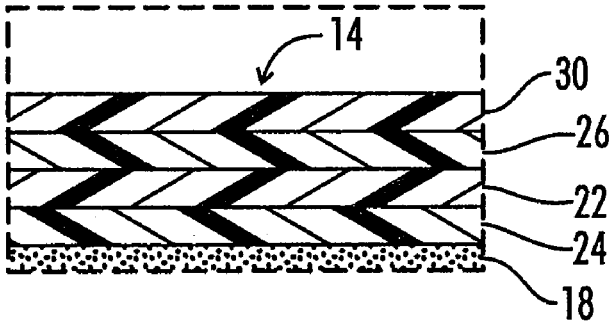
FIG. 8 shows an enlarged cross sectional view of the structure of the top multilayer sheet of FIG. 5.

As shown in FIG. 8, the multilayered film sheet 14 which is laminated to one face of the base sheet includes a film 22 of ethylene vinyl alcohol sandwiched between films 24, 26 of nylon and bonded to an outer film 30 of linear low-density polyethylene. A suitable film sheet material with such construction and having a thickness of three mils is available from Print Pack, Inc., under the designation Omniflex™, No. C44-442.

Figure 9:
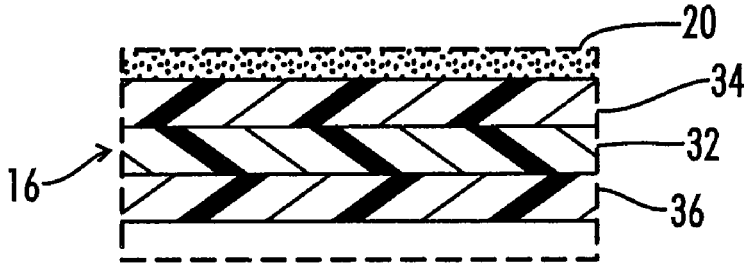
FIG. 9 shows an enlarged cross sectional view of the structure of the bottom multilayer sheet of FIG. 5.

FIG. 9 shows the structure of the film sheet 16 bonded to the other face of the base sheet. Film sheet 16 has a central layer 32 of polyvinylidine chloride with an ethylene vinyl acetate layer 34 on the inner face of the composite and a low-density polyethylene film 36 on the outside. Such film sheet material is manufactured and sold by Dow Chemical Company under the trademark Saranex 23P™.

As shown in FIG. 7, an adhesive film 18 is provided for lamination of base sheet 12 to the ethylene vinyl alcohol-containing sheet 14. The adhesive is selected for its compatibility with unwoven polypropylene and with the nylon film to which the ethylene vinyl alcohol film is bonded. In this example, a blended mixture of EMA (ethylene methyl acrylic) and low-density polyethylene may be used for this purpose. Preferably, the adhesive is applied to a thickness of about 1 to about 1.25 mils. Similarly, an adhesive layer 20, which may be the same adhesive composition, is provided between the polypropylene base sheet 12 and polyvinylidine chloride containing sheet 16.

To provide the desired color to the fabric, pigments may be incorporated in the adhesive mixture with different colored pigments being preferred for the two films. For example, film 18 may include blue pigment, while film 20 includes a white pigment.

Fabrics embodying the invention may be prepared by means of extruding the adhesive layer between the base fabric and each film sheet and immediately cooling the composite with a chill roller.

In another embodiment, the barrier fabric of the present invention can be the fabric disclosed in United States Patent Application 20010051481, incorporated herein by reference. In this embodiment, the barrier fabric is a flexible, heat sealable, multi-layered chemical barrier material or fabric that has been coated on one or more sides with a layer of halogen-free thermoplastic polyolefin elastomer resin (TPO).

In other embodiments of the present invention, the barrier fabric may be the fabric disclosed in U.S. Pat. No. 4,920,575 to Bartasis et al. In this embodiment, the barrier fabric comprises a high barrier, multi-layer film incorporating EVOH (ethylene vinyl alcohol) laminated to a spunbonded polyester substrate. The fabric of this embodiment is a five-layer construction with a layer of EVOH in the middle, bracketed by water-resistant bonding resin layers and outer layers of polyethylene or polyester. The substrate may be formed with low temperature binders and is calendered on both sides, the outer side being calendered much more extensively than the inner side. The material is joined together at pattern edges by thermal bonding under pressure or by a strip of the film thermal bonded to material segments.

The barrier fabric of this embodiment may comprise an outer film of a synthetic material manufactured and sold by the British Petroleum Corporation. The film is laminated to an inner substrate of spun-bonded polyester material. A layer of adhesive is provided between the film and the substrate to enhance the bond between them. In embodiments, the film may be a five-layered product. In these embodiments, the first or inner layer of the film may be a polyethylene layer. The second layer may be a "tie layer" of water resistant adhesive resin. The third or center layer may be EVOH. The fourth layer another layer of water resistant adhesive resin. The fifth, or outer, layer of this embodiment is another layer of polyethylene. The substrate of this embodiment may be a spunbonded polyester material incorporating low temperature binders. The binders may be ethyl vinyl acetate (EVA), or polyvinyl acetate (PVA), for example. While this substrate is formed using conventional methods, it may be calendered on both sides. The film and the substrate are laminated with the adhesive layer between them. The adhesive layer, which is an ethyl vinyl acetate (EVA) resin, is a thin layer applied to the film before lamination. The lamination process completes the fabrication of the material of this embodiment. Thermal bonding may be used to form the seams.

Closure Devices

In embodiments of the present invention, commercially available gas-tight or air-tight zippers may be used to open and close the pouch.

One example is a commercially available 72" gas-tight PVC zipper, 2, available from YKK, is hermetically sealed into the high chemical barrier fabric of the present invention.

When the zipper and barrier fabrics are of dissimilar and non-compatible materials, an interface material may be used to bond the zipper to the base material. A thermoplastic interface material acts as a buffer between the zipper and the chemical fabric material, and also serves as a method of encapsulating the sew line between the zipper and the pouch. The thermoplastic interface material of the present invention is a composite structure including a layer of chlorinated polyethylene thermally laminated to a layer of a polyvinyl chloride/chlorinated polyethylene alloy. An advantage of this interface material is the adsorptive characteristics of the PVC/CPE alloy. Flexible PVC zippers contain substantial amounts of migratory plasticizers. These oily compounds continuously bloom to the surface, which limits the heat-sealability of this class of polymers. The interface material of the present invention helps to obviate this limitation, thereby expanding the number of alternative materials to which a plasticized thermoplastic zipper can be heat-sealed. In this embodiment, the CPE/PVC alloy contains a sufficient amount of PVC that can readily absorb any migrating plasticizer while maintaining the heat seal to the outer surface of the zipper. The alloy layer also contains a sufficient quantity of CPE to allow thermal bonding to the CPE layer, which serves as the outermost layer of the interface material composite.

Finally, sufficient heat and pressure are applied to the interface material so as to create a thermal bond between the alloy surface of the interface material and the outer surface of the zipper. Traditional continuous heat seal equipment such as is available from Queen Light Electronics Industries, NaWon Machinery, and Pfaff can be used to accomplish the sealing described herein.

The seams in the pouch may be sewn as known in the art. For example, a single-needle lock-stitch with 70 denier, textured nylon thread may be used. While a single-needle lock stitch is preferred, when attaching the zipper to the pouch, alternative stitch types can be used. Traditional sewing machinery such as that available through Brother Industries, Ltd., Mauser, and Juki Corporation can be used to accomplish the objectives of the present invention.

In another embodiment, at least one layer of heat seal tape such as that described by Langley (U.S. Pat. No. 5,169,697) may be applied over sew lines at a heat and pressure sufficient to cause a thermal bond between the interior, ethylene vinyl acetate surface of the seam tape, and the exposed, chlorinated polyethylene (CPE) surface of the interface material. The tape of this embodiment is a heat-bondable tape for making seams between pieces of chemical barrier composite fabrics and between such fabrics and other components of protective garments and to a method of forming such seams. The seaming tapes include a first, base multilayer sheet that is usable by itself for certain less-demanding applications and a second multilayer sheet that, when laminated to and combined with the base sheet, provides an effective barrier to a wide spectrum of chemicals, giving a durable seam with the same barrier ability as is provided by the barrier fabric disclosed in my prior patent, referenced above. A sheet of polyethylene may also be disposed between the multilayered sheets to provide enhanced adhesion in forming the component sheets into a single tape.

The base multilayer sheet is made up of a stacked, laminated array of successive layers of polymeric film including an outside layer of ethylene vinyl acetate, which layer in use is disposed in contact with the fabric being seamed, a layer of polyvinylidene chloride, a second layer of ethylene vinyl acetate, and an outside layer of chlorinated polyethylene. The second multilayer sheet, which is included in the preferred combination, includes an interior layer of ethylene vinyl alcohol sandwiched between layers of nylon or polyethylene.

Preparation of a seam between pieces of the barrier fabric may be carried out by placing the seaming tape over the fabric along the seam line with the ethylene vinyl acetate outside layer of the base tape in contact with the fabric and applying heat and pressure to obtain bonding with the fabric substrate. To obtain stronger and more durable seams, the fabric region may be stitched together, with the seaming tape covering the stitching to avoid leakage through needle holes. In addition, the seaming tape may be applied to both sides of the fabric as well as to one side only to provide a greater barrier effect. Finally, the seam tape may be used to seal the air exchange mechanism area as well.

Seaming tapes and methods embodying the invention provide highly effective seams for protective garments, with the resulting seams showing the same barrier properties as the fabric itself, although a lesser degree of effectiveness suitable for some applications may be obtained by using only a single multilayer tape as described herein.

Air Pressure Valve

The pouch of the present invention also comprises a uni-directional air exchange mechanism, that effectively filters and releases build-up of gases inside the pouch. See, for example, 3, in FIG. 1. An example of this valving system is described further under FIG. 3, which shows the air management system required to enable transport under hypobaric conditions. The theory has been borrowed from the air-purifying respiratory market. In a respirator, air is brought through a filter cartridge or canister and into the mask for inhalation by the wearer, a flapper valves closes the cartridge passage and exhaled air exists through a second one-way valve. This bi-directional flow is effective for respiratory equipment but inadequate for the remains pouch since air must flow uni-directionally out of the pouch.

Figure 3:
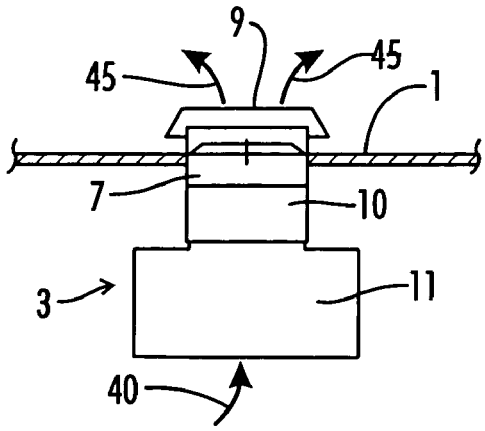
FIG. 3 shows an example of an air management system of the present invention.
Figure 4:
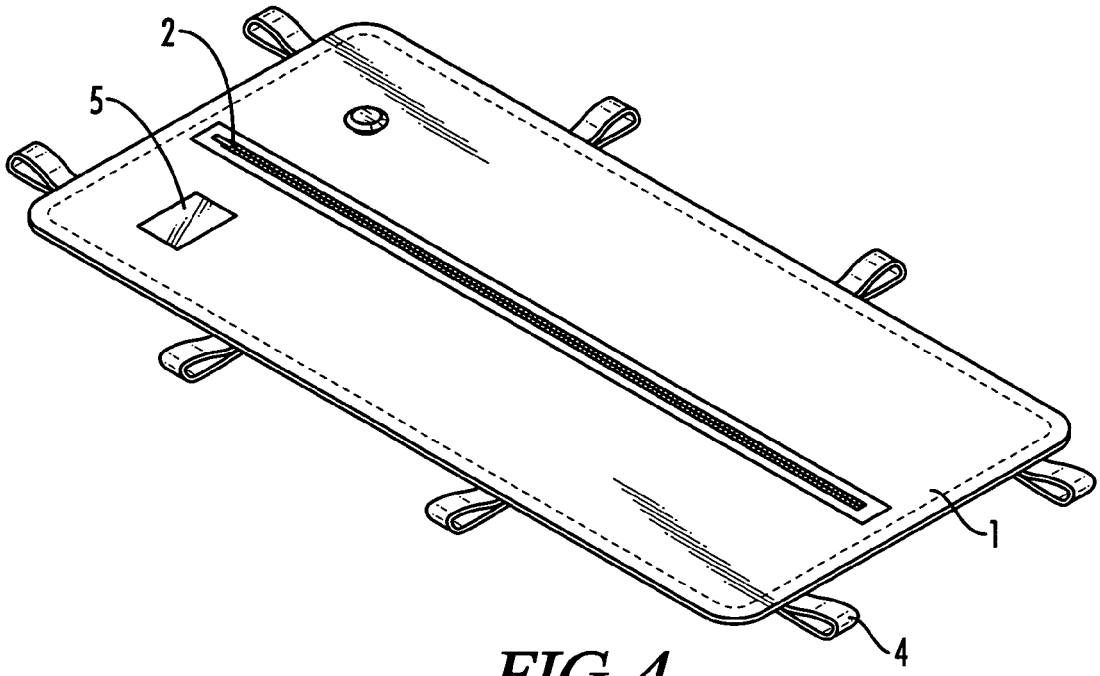
FIG. 4 is a perspective view of the embodiment of FIG. 1.

Three approaches are described herein, however others could be utilized and are considered within the scope of the present invention. One embodiment of the present invention, as shown in FIG. 3., utilizes a typical valve body, 7, that is fitted in the base fabric, 1, and positioned such that air can be exhausted from the pouch but is prevented from re-entering the pouch by the flapper, 8. In addition to the one-way flapper valve 8, multiple rings of adsorptive fabric can be inserted within the valve body above or below the flapper, thus creating a path of adsorptive media (such as activated carbon) through which any air must flow whence entering or exiting the garment. Obviously greater filtering efficiency can be achieved using thick layers of sorptive fabric (such as a chemsorptive disk). The valve body 7 is cover on the exterior with a valve cover 9, to prevent damage to the flapper. Contaminated air 40 flows through the valve, is filtered and discharged as filtered air 45.

Other approaches can be employed in addition to or in place of the chemsorptive disks inserted in the valve body to filter the air being vented from the pouch. Preferred is to interface a typical air purifying respiratory canister or cartridge 11, through a coupling 10. In this case a standard military C2A1 NBC canister is fitted to the exhaust valve body with an ISO coupling 10. This configuration will channel all air exiting the pouch through the NBC filter and by the flapper valve. The novelty of this approach over all other body bag designs is that the exhaust valve can be used as part of an ongoing quality assurance process to ensure the gas-tight integrity of the entire unit. This configuration allows for pressure testing according to ASTM F1052.

An alternative approach for managing potentially contaminated air flow into a pouch is to fit either single or multiple layers of sorptive fabric over an opening in the pouch, which has the same net effect as the valve body inserts. The sorptive material can be attached to the interior of the pouch according to several different techniques including adhesives, heat-sealing within a barrier fabric frame/enclosure or other means.

A third approach to creating a functional uni-directional air exchange mechanism is to combine the valve body and adsorptive inserts, with a secondary air infiltration bag not unlike a disposable vacuum cleaner bag. In this case, a bag is fitted around the interior of the valve body and is either constructed of or contains filtration (adsorptive or reactive) media. The principle here again is to force any air through the sorptive media thus filtering the air exhausted from the pouches. In this type of approach it is critical to protect the chemisorptive media from liquid contamination. Further examples of the valving system of the present invention can include various zero pressure flapper valves and spring activated valves with a set cracking pressure.

FIGS. 1, 2, and 4-6 show an embodiment of the present invention. Here again the primary material 1, is a high chemical barrier fabric. The pouches of the present invention can be made by sewing and stitching the fabric as generally understood in the art. In this embodiment a separate layer of abrasion resistant material, 6, has been hermetically sealed to the bottom of the bag around is periphery. The abrasion resistant layer in this embodiment is about a 14 oz/yd$^2$ polyvinyl chloride (PVC) available from Cooley, Inc. (Pawtucket, R.I.). The PVC material is yellow in color and is comprised of a about 50/50 coating weight on each side of about 4.7 oz/yd$^2$ polyester woven support. Fabric characteristics include a grab tensile strength of about 375 lbs (warp)/350 lbs (fill), strip tensile strength of about 280 lbs (warp)/200 lbs (fill), and a tongue tear strength of about 65 lbs (warp)/65 lbs (fill).

The pouch of the present invention may be fitted with straps. For example, the embodiment depicted in FIGS. 1, 2 and 4-6 is fitted with eight (8) 2" wide heavy-duty (greater than about 1000 lb tensile) carrying straps, 4. These straps are located equal distance around the pouch and include and ~12" looped end to facilitate easy of handling by gloved hands. Additionally, these straps are sewn directly to the abrasion resistant PVC bottom material, sewing and seaming of which does not disrupt the gas-tight integrity of the pouch itself.

Figure 1:
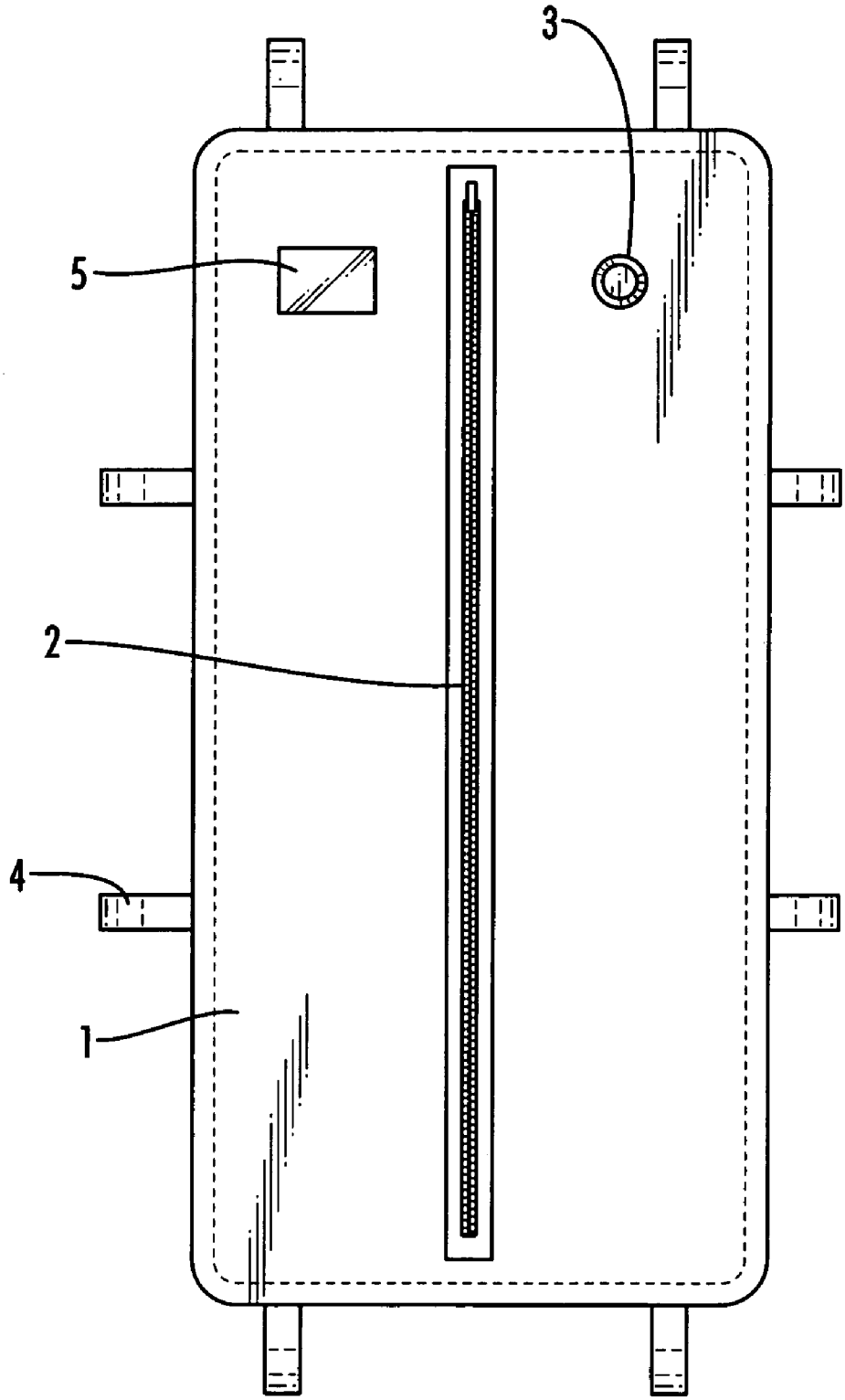
FIG. 1 shows a preferred embodiment of a remains pouch of the present invention.
Figure 2:
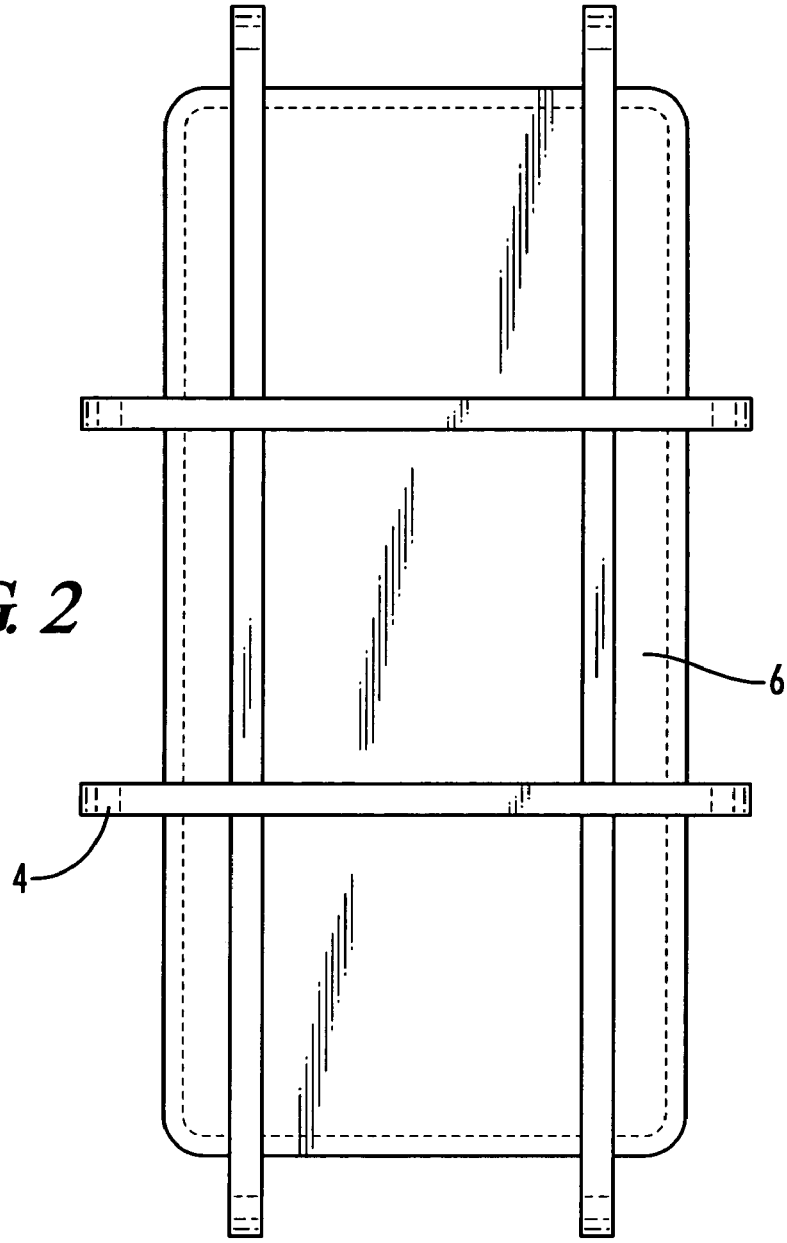
FIG. 2 shows the bottom side of the embodiment of FIG. 1.
Figure 5:
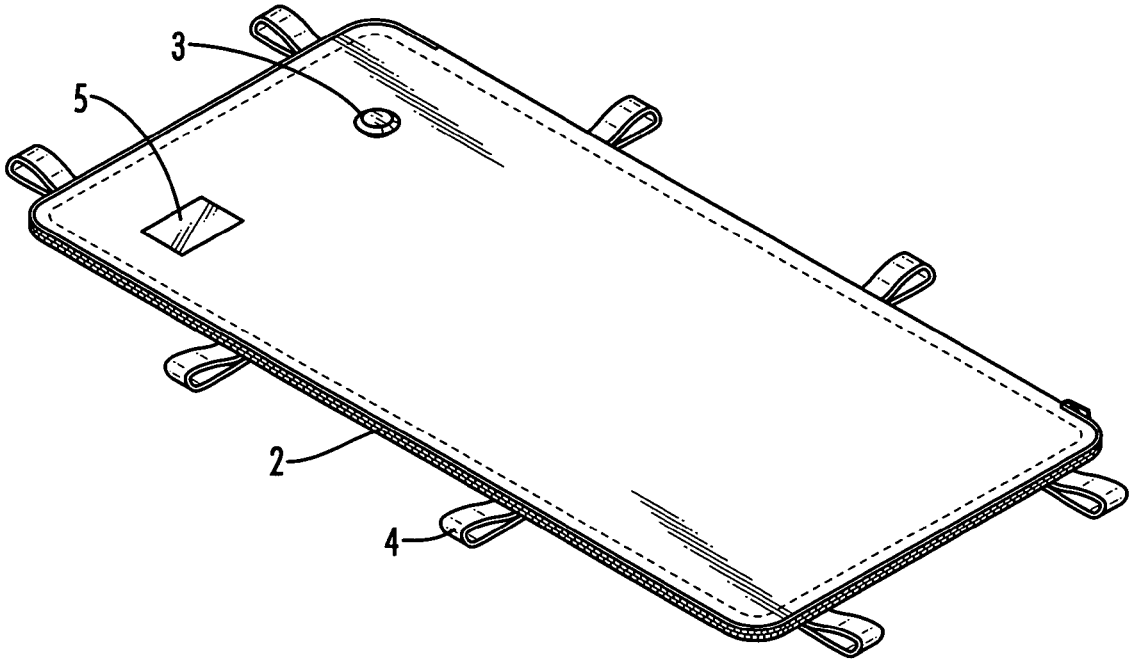
FIG. 5 is the same perspective view as shown in FIG. 4. However, in this Figure, the zipper is located around the sides of the pouch rather than down the top of the middle of the pouch.

This embodiment also includes a remains identification card and envelope 5 that allows for the recoding of personal information of the remains or forensic sample held in the pouch. The opening and closing means in the figures is a zipper/thermoplastic interface 2. As shown in FIGS. 2 and 5, the location of the zipper is not critical.

The interior of the pouch can be further fitted with a fluid-collection reservoir system, 5*a*, which is comprises of a series of commercially available hydrophilic collection pads located in the bottom of the remains pouch. The system fitted in this embodiment has a maximum adsorption capacity of 1 gallon and based on available super adsorbent polymers (SAPs).

Figure 6:
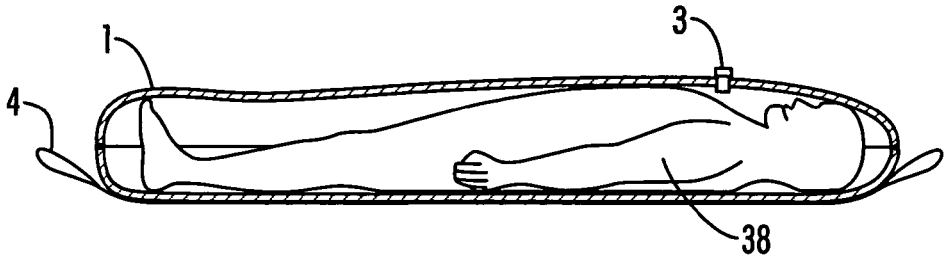
FIG. 6 shows an embodiment of the present invention in use carrying human remains.

Finally, FIG. 6 shows the pouch of this embodiment in use storing a body 38.

The invention thus being described in the Specification and Drawings, it will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. Particularly, it should be obvious that the subject patent is applicable to other base chemical fabrics, zipper materials, valving systems, and fluid collection media.

Throughout this disclosure, various publications are referenced, specifically those included in the "References Cited" section, above. All references cited herein are expressly incorporated herein by reference in their entirety and are considered to be part of this disclosure.

We claim:

1. A container for storing or transporting at least one contaminated item, comprising:

a plurality of polymeric, multi-layered chemical composite flexible walls that are impervious to gases and liquid and define an interior chamber that has sufficient dimensions to accommodate said contaminated item;

a gas-tight closable and openable opening for placing and removing said contaminated item in the interior chamber; and an air management system that filters and releases pressure from the inside of said interior chamber and includes:

a pressure relief valve to allow the release of gasses to prevent over pressurization in the container, and an air-purifying system that comprises at least one of an air-purifying cartridge or canister to filter air exiting the container through the valve.

2. The container of claim 1, wherein said at least one contaminated item is a human or animal body, bodily remain, or forensic sample.

3. The container of claim 1, wherein said multi-layered chemical composite is a thermoplastic resin selected from the group consisting of polyvinyl chloride, chlorinated polyethylene, chlorinated butyl, polyethylene, high density polyethylene, low density polyethylene, linear low density polyethylene, polypropylene, polyurethane, PTFE, combinations thereof, or multiple-layered coextruded films which include one or more layers of ethylene-vinyl acetate, ethylene vinyl alcohol, polyvinyl alcohol, nylon, Surlyn (ionomer), polyester.

4. The container of claim 1, wherein the air-purifying canister comprises a nuclear, biological, and/or chemical filter canister.

5. The container of claim 1, wherein the air-purifying respirator cartridge or canister comprises at least one layer of chemsorptive media.

6. The container of claim 5, wherein the chemsorptive media is activated carbon.

7. The container of claim 5, wherein the chemsorptive media is nuclear, biological, and chemical absorbent.

8. The container of claim 1, wherein the container maintains about 4-inch positive air pressure with up to about a 20 percent drop in pressure after four minutes in a standard inflation test.

9. The container of claim 1, wherein said gas-tight closable and openable opening is a zipper.

10. The container of claim 9, wherein the zipper comprises PVC, PE, Hytrel, PP, butyl, neoprene.

11. The container of claim 9, further comprising a thermoplastic interface material that joins the zipper with the multi-layered chemical composite.

12. The container of claim 1, wherein the multi-layered chemical composite is resistant to at least one of Sarin, Mustard, Soman, nerve agent, Lewisite, tear gas.

13. The container of claim 1, wherein the multi-layered chemical composite is resistant to toxic industrial chemicals.

14. The container of claim 1, wherein said multi-layered chemical composite is layered with a thermoplastic polyolefin elastomer layer.

15. The container of claim 1, wherein said walls form an extended tubular body.

16. The container of claim 1, wherein said walls are joined by hermetic seams.

17. The container of claim 16, wherein said seams are sealed with a chemically resistant tape.

18. The container of claim 16, wherein said seams are sealed with heat, radio frequency welding, or impulse welding.

19. The container of claim 1, further comprising a polymeric abrasion-resistant fabric surface.

20. The container of claim 19, wherein the polymeric abrasion-resistant fabric comprises polyvinyl chloride.

21. The container of claim 1, wherein the interior chamber comprises a super adsorbent polymer.

22. The container of claim 21, wherein the interior chamber comprises adsorbent pads adhered to the walls that define said chamber.

23. A container for storing or transporting at least one contaminated item, comprising:

a polymeric composite flexible wall that is impervious to gases and liquid and define an interior chamber that has sufficient dimensions to accommodate said contaminated item;

a gas-tight closable and openable opening for placing and removing said contaminated item in the interior chamber; and an air management system that filters and releases pressure from the inside of said interior chamber and includes:

a pressure relief valve to allow the release of gasses to prevent over pressurization in the container, and an air-purifying system that comprises at least one of an air-purifying cartridge or canister to filter air exiting the container through the valve.

* * * * *